US005946524A

United States Patent [19]

Taniguchi

[11] Patent Number: 5,946,524

[45] Date of Patent: Aug. 31, 1999

[54] IMAGE FORMING APPARATUS AND IMAGE DENSITY REGULATING METHOD

[75] Inventor: Toshihide Taniguchi, Toyokawa, Japan

[73] Assignee: Minolta Co., Ltd., Osaka, Japan

[21] Appl. No.: 09/201,781

[22] Filed: Dec. 1, 1998

[30] Foreign Application Priority Data

Dec. 4, 1997 [JP] Japan ..... 9-334350

[51] Int. Cl.[6] ..... G03G 15/10

[52] U.S. Cl. ..... 399/59; 399/43; 399/50

[58] Field of Search ..... 399/43, 45, 48, 399/49, 50, 53, 55, 51, 58, 56, 59, 72, 94, 97

[56] References Cited

U.S. PATENT DOCUMENTS 4,312,589 1/1982 Brannan et al. ..... 399/49
5,826,136 10/1998 Saiko et al. ..... 399/49

FOREIGN PATENT DOCUMENTS 55-127571 10/1980 Japan .
58-221869 12/1983 Japan .
61-128269 6/1986 Japan .
5-40384 2/1993 Japan .

*Primary Examiner*—Arthur T. Grimley
*Assistant Examiner*—Hoang Ngo
*Attorney, Agent, or Firm*—Burns, Doane, Swecker & Mathis, LLP

[57] ABSTRACT

A test pattern image is formed on a photosensitive drum, and the density of the test pattern image is detected by a sensor. The grid voltage Vg of an electrifying charger and the toner concentration T/C in a developer are adjusted according to the detection result so that a target image density can be obtained. Every time a specified number of copies are made in a multiple copying operation, the adjusting target value of the toner concentration T/C is lowered by one step, and the adjusting target value of the grid voltage Vg is heightened by one step.

14 Claims, 6 Drawing Sheets

IMAGE FORMING APPARATUS AND IMAGE DENSITY REGULATING METHOD

This application is based on application No. 9-334350 filed in Japan, the contents of which are hereby incorporated by reference.

BACKGROUND OF THE INVENTION

1. Field of the Invention

The present invention relates to an image forming apparatus which forms an image on a photosensitive member by an electrophotographic method and an image forming apparatus which forms an image by depositing charged ink on an electrostatic latent image bearing member electrostatically, and a method of regulating the image density in such an image forming apparatus.

2. Description of Prior Art

In electrophotographic copying machines and printers, conventionally, in order to keep a proper image density, a test pattern image with a specified area is formed on a photosensitive drum, the density of the test pattern image is optically detected, and the voltage applied to the photosensitive drum, the developing bias voltage, the toner concentration or the exposure value is adjusted according to the result of the detection. Such control is required because optimal image forming conditions to achieve a proper image density are changeable with deterioration of the photosensitive member and the developer (carrier) and with a change in environments. Especially, developers are apt to be influenced by environmental conditions, and under high temperature and high humidity, the developing efficiency declines remarkably. A decline in developing efficiency means a decline in image forming conditions, and in this case, it is necessary to heighten the voltage applied to the photosensitive drum or the toner concentration.

Now, adjustment of the voltage to be applied to the photosensitive drum and adjustment of the toner concentration are compared with each other. Adjustment of the voltage to be applied to the photosensitive drum has an advantage that the image density changes soon in response to adjustment of the voltage but has a disadvantage that underexposure occurs in the background of an image when the voltage becomes too high. Setting of a large exposure value will increase power consumption of the lamp, raise temperature and accelerate aging of the lamp and the photosensitive drum, and in order to avoid such problems, the exposure value cannot be set so large. On the other hand, adjustment of the toner concentration does not cause trouble such as underexposure. However, the toner concentration changes only gradually, and the response of the image density to adjustment of the toner concentration is slow. Moreover, when the toner concentration becomes too high, toner sticks to unnecessary portions of an image, which results in image noise.

Therefore, by combining adjustment of the voltage to be applied to the photosensitive drum with adjustment of the toner concentration, the image density can be effectively regulated.

By the way, when a large number of copies are made continuously, especially in a high-speed apparatus which makes 60 copies or more per minute, the temperature in the apparatus increases, and the characteristics of the developer degrade. Accordingly, there arise problems such as spraying of toner from the developing section and deposition of toner in the background of an image. With the above-mentioned control which is a combination of adjustment of the voltage to be applied to the photosensitive drum with adjustment of the toner concentration, although the image density is controllable to be constant, problems such as toner spraying and toner deposition occur in a multiple copying operation (especially in a duplex copying operation).

SUMMARY OF THE INVENTION

An object of the present invention is to provide an image forming apparatus and an image density regulating method which can control the image density to be constant and prevent problems such as toner spraying and toner deposition from arising in a continuous image forming operation.

In order to attain the object, according to the present invention, an image forming apparatus which forms an image on a photosensitive member by an electrophotographic method is so constructed to comprise: a detecting device for detecting a state of an image formed on the photosensitive member; a first adjusting device for adjusting a toner concentration in a developer according to a detection result of the detecting device; a second adjusting device for adjusting a voltage to be applied to the photosensitive member according to the detection result of the detecting device; a counting device for counting continuously formed images; and a control device which lowers a target value of the toner concentration to be achieved by the first adjusting device according to a count value of the counting device.

According to the present invention, a reference value which is suitable under optimal conditions is given to each of the toner concentration and the voltage applied to the photosensitive member, and in ordinary cases, the toner concentration and the voltage are adjusted so as to become closer to the respective target values. Thereby, the image density can be kept constant at all times. On the other hand, as the number of continuously formed images is increasing, the adjusting target value of the toner concentration is lowered from the reference value. Thereby, the toner concentration in the developer declines, and even when the temperature in the apparatus rises, the toner is well stirred and charged. Consequently, spraying of the toner from the developing section and deposition of the toner in the background of an image can be prevented.

It is preferred that the adjusting target value of the toner concentration is lowered by one step every time a specified number of images are continuously formed. Because this control responds to the condition of the apparatus well, this is more effective. Moreover, in order to maintain good developing performance, it is preferred that the adjusting target value of the voltage applied to the photosensitive member is heightened by one step when the adjusting target value of the toner concentration is lowered by one step.

Also, preferably, if the target value of the toner concentration and/or the target value of the voltage applied to the photosensitive member are/is lower or higher than the respective reference values when a continuous image forming operation is completed, the target values are one step lowered and heightened, respectively. It is unknown whether or not the next image forming operation is to make a large number of images, and in order to prevent the target values from further diverting from the reference values, the target values are controlled to be closer to the respective reference values.

Further, the present invention is applicable not only to an image forming apparatus which forms a toner image on a photosensitive member by an electrophotographic method but also to an image forming apparatus which makes coloring stick to an image bearing member without using a photosensitive member, for example, is of a liquid developing type or of an ink developing type. Such an image forming apparatus according to the present invention comprises: an image bearing member; a latent image forming device for forming a latent image on the image bearing member according to a target value of an intensity level of a latent image; a developing device for developing the latent image according to a target value of an image density; a counting device for counting developments carried out by the developing device; and a control device for changing the target value of the image density according to a count value of the counting device.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An exemplary image forming apparatus and an exemplary image density regulating method according to the present invention are hereinafter described with reference to the accompanying drawings.

Figure 1:
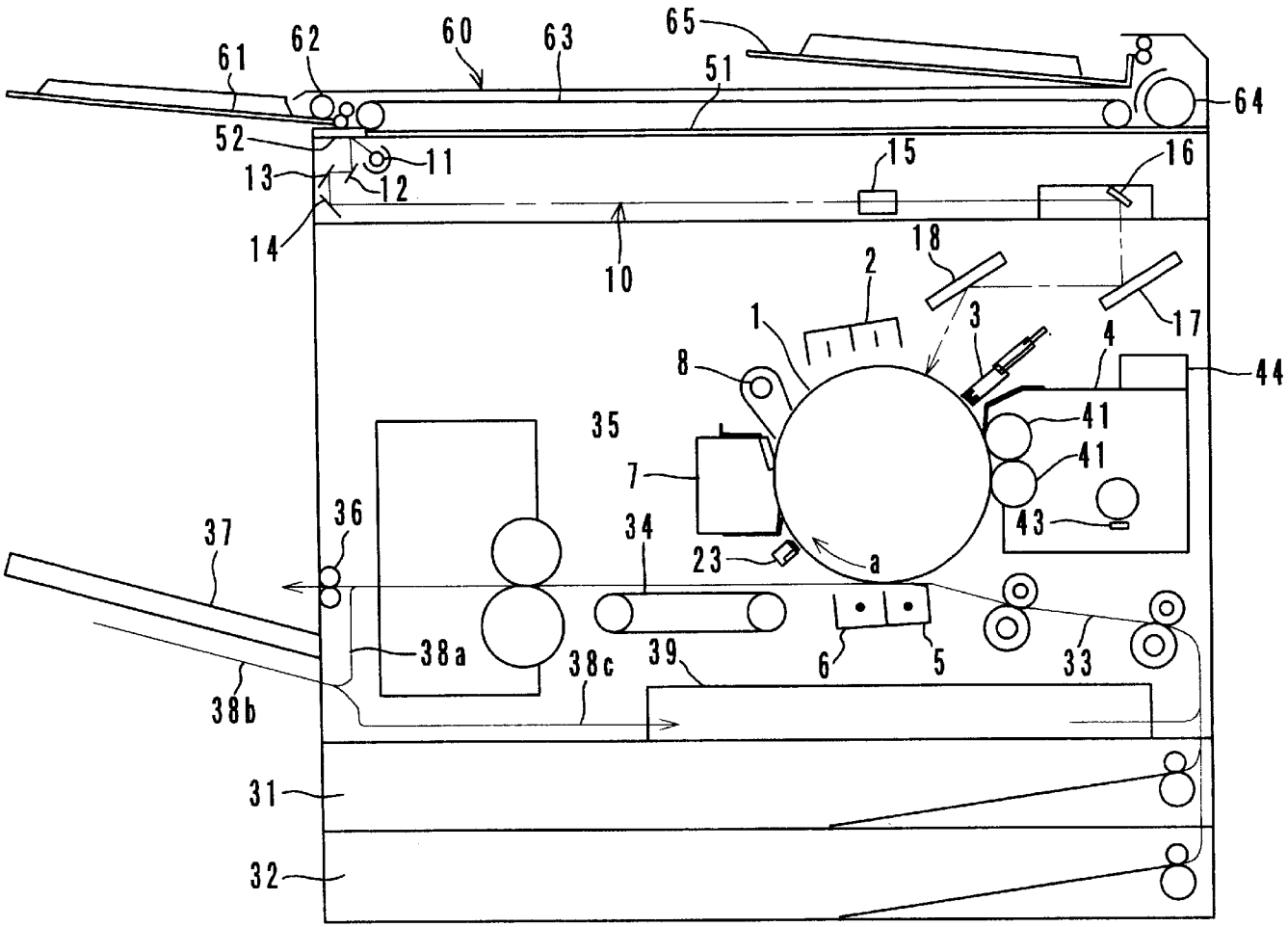
FIG. 1 is a schematic view of a copying machine which is an embodiment of the present invention.

FIG. 1 is a schematic view of an electrophotographic copying machine according to the present invention.

This copying machine has a photosensitive drum 1 which is driven to rotate in a direction indicated with arrow "a" is provided in the center. Around the photosensitive drum 1, there are provided in the direction of arrow "a", an electrifying charger 2, an image interval/end eraser lamp 3, a developing device 4, a transfer charger 5, a sheet separation charger 6, a residual toner cleaner 7 and a residual charge eraser lamp 8. An image exposure optical system 10 comprises an exposure lamp 11, mirrors 12, 13 and 14, an imaging lens 15, and mirrors 16, 17 and 18. The optical system 10 exposes the photosensitive drum 1 so as to reproduce an image of a document set on a document glass 51 on the photosensitive drum 1. The optical system 10 and these image forming elements are well known, and the description thereof is omitted.

On the copying machine, an automatic document feeder (hereinafter referred to as ADF) 60 is installed. The ADF 60 is of a well-known structure, and feeds documents from a document tray 61 one by one with rotation of a pick-up roller 62 and transports each document to a specified position on the document glass 51 with rotation of a conveyer belt 63. While the document stays in the specified position, the optical system 10 carries out image exposures to form a number of images as inputted beforehand. After the image exposures, the document is discharged onto a tray 65 through an inversion/discharge roller 64. Further, the ADF 60 can handle duplex documents which have images on both sides. After image exposures of a first side of a document, the document is inverted around the inversion/discharge roller 64 and returned onto the document glass 51 for image exposures of its second side.

Now, the procedure of copying is generally described.

While the photosensitive drum 1 is rotating in the direction of arrow "a", first, the surface of the drum 1 is uniformly charged by discharge from the electrifying charger 2, and a document image is reproduced on the drum 1 as an electrostatic latent image. The electrostatic latent image is developed into a toner image by toner in a developer while passing the developing device 4.

Meanwhile, copy sheets are fed from a feed tray 31 or 32 one by one, and each sheet is transported in a transport path 33 and fed to a transfer section in synchronization with the toner image formed on the photosensitive drum 1. In the transfer section, the toner image is transferred onto the sheet by discharge from the transfer charger 5, and immediately, the sheet is separated from the drum 1 by AC discharge from the separation charger 6. Thereafter, the sheet is fed into a fixing device 35 by an air suction belt 34, and the toner image is fused on the sheet. Then, the sheet is discharged from the machine 1 onto a tray 37 through discharge rollers 36. The photosensitive drum 1 still continues rotating in the direction of arrow "a" so that residual toner can be cleaned by the cleaner 7 and that residual charge can be erased by the eraser lamp 8. Thus, the photosensitive drum 1 gets ready for next copying.

Further, the copying machine can carry out duplex copying. In duplex copying, a copy sheet which has obtained an image on its first side is guided into a transport path 38*a* diverging right before the discharge roller 36, makes a switchback in a switchback path 38*b* and is transported to an intermediate tray 39 through a transport path 38*c*. The sheet which has stored in the intermediate tray 39 once is refed to the transport path 33 to obtain another image on its second side.

Figure 2:
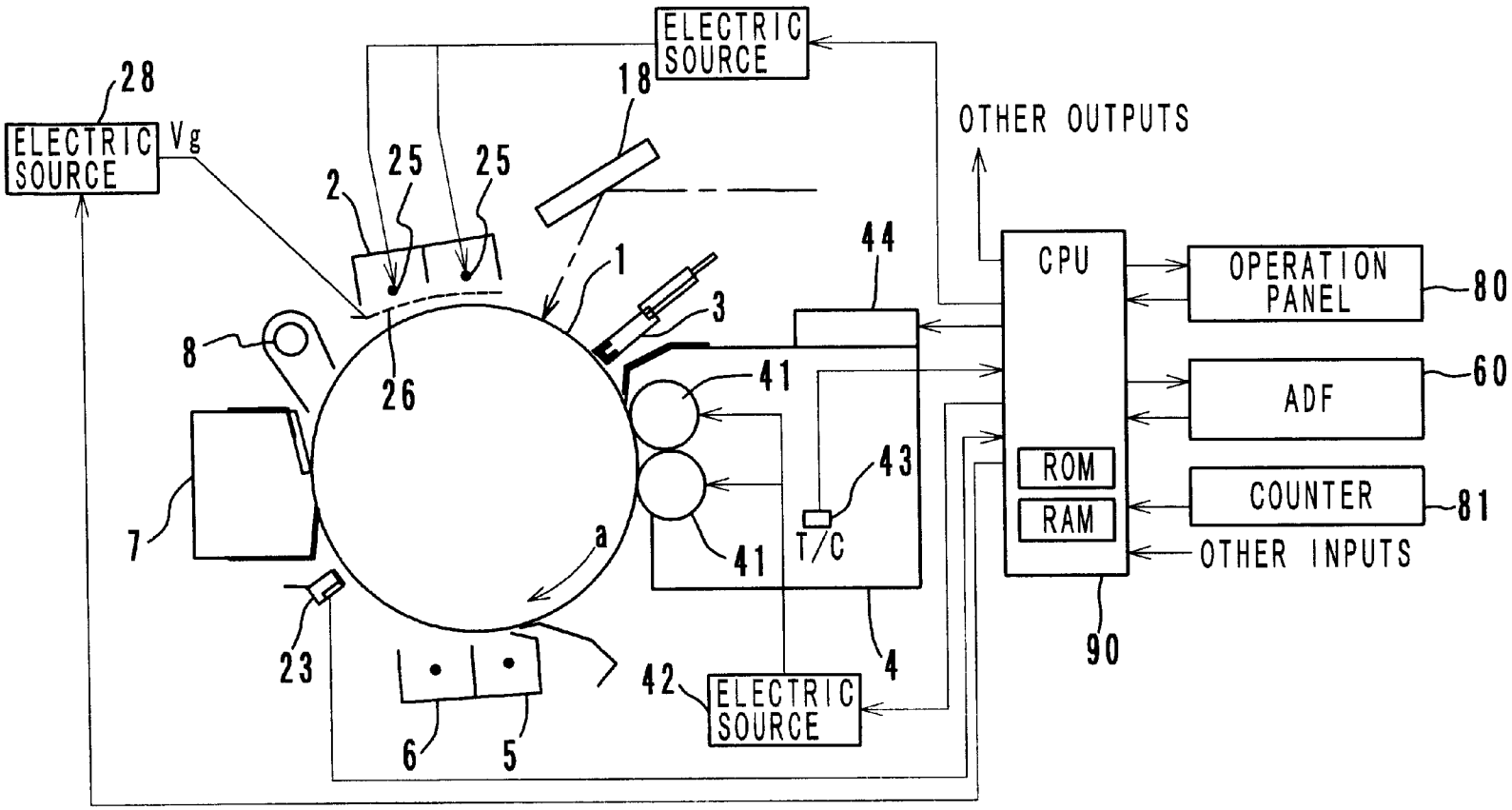
FIG. 2 is schematic view of an image forming section and a control circuit of the copying machine.

FIG. 2 shows the image forming elements and a control mechanism of these elements.

The electrifying charger 2 is a scorotron charger with a mesh grid 26. A specified high voltage is applied to a discharge wire 25 of the charger 2 from an electric source 27, and a voltage Vg corresponding to the voltage to which the photosensitive drum 1 is to be charged is applied to a grid 26 of the charger 2 from an electric source 28. The developing device 4 has two developing rollers 41 for developing an electrostatic latent image, and a specified developing bias voltage is applied to the developing rollers 41 from an electric source 42. A magnetic sensor 43 is provided in a developer tank to detect the toner concentration T/C of the developer. When the magnetic sensor 43 detects a value lower than a target value (which will be described in detail later), toner is supplied to the developer tank from a toner hopper 44 .

Further, in order to carry out an image density regulation process, a test pattern 52 colored in black is provided at the end of the document glass 51, and an optical sensor 23 for detecting the image density on the photosensitive drum 1 is provided immediately before the cleaner 7. The image density regulation process is carried out when a predetermined number of copies have been made since the image regulation process was carried out last time or when an operator commands execution of the image density regulation process.

First, the surface of the photosensitive drum 1 is charged by the electrifying charger 2 and is exposed to a light reflected from the test pattern 52 (actually, the quantity of the reflected light is very little), and an electrostatic latent image of the test pattern is formed in a specified area while the photosensitive drum 1 is passing by the eraser lamp 3. Next, the latent image is developed into a toner image by the developing device 4, and the toner image of the test pattern passes by the chargers 5 and 6 which are kept off. Then, the density of the test pattern image is detected by the sensor 23 immediately before the cleaner 7.

If the detected density of the test pattern image is not a predetermined target value, the grid voltage Vg of the electrifying charger 2 is adjusted so as to change the voltage to be applied to the photosensitive drum 1. In this way, adjustment of the voltage to be applied to the photosensitive drum 1 for achievement of the desired image density is carried out prior to adjustment of the toner concentration. Further, if the grid voltage Vg has been changed to its upper limit or to its lower limit, then the toner concentration T/C is adjusted while the grid voltage Vg is kept in the upper limit or the lower limit.

In ordinary copying machines, the grid voltage Vg (the voltage to be applied to the photosensitive drum 1) is changeable within a range from approximately 400 V to approximately 1000 V, and the toner concentration T/C is changeable within a range from approximately 3% to approximately 15%. In such a case, 700 V is the initial target value (reference value) of the grid voltage Vg, and the grid voltage Vg is changed by approximately 50 V at one step. With respect to the toner concentration T/C, 9.0% is the initial target value (reference value), and the toner concentration T/C is changed by 1.0% at one step. However, the changeable ranges and the initial target values (reference values) are determined depending on the characteristics of the photosensitive drum 1 and those of the developer.

In the image density regulation process, if the detected density of the test pattern image is not the desired value, first, the current toner concentration T/C is judged whether to be the target value or not. If the toner concentration T/C is not the target value, the toner concentration T/C is changed by one step.

Figure 3:
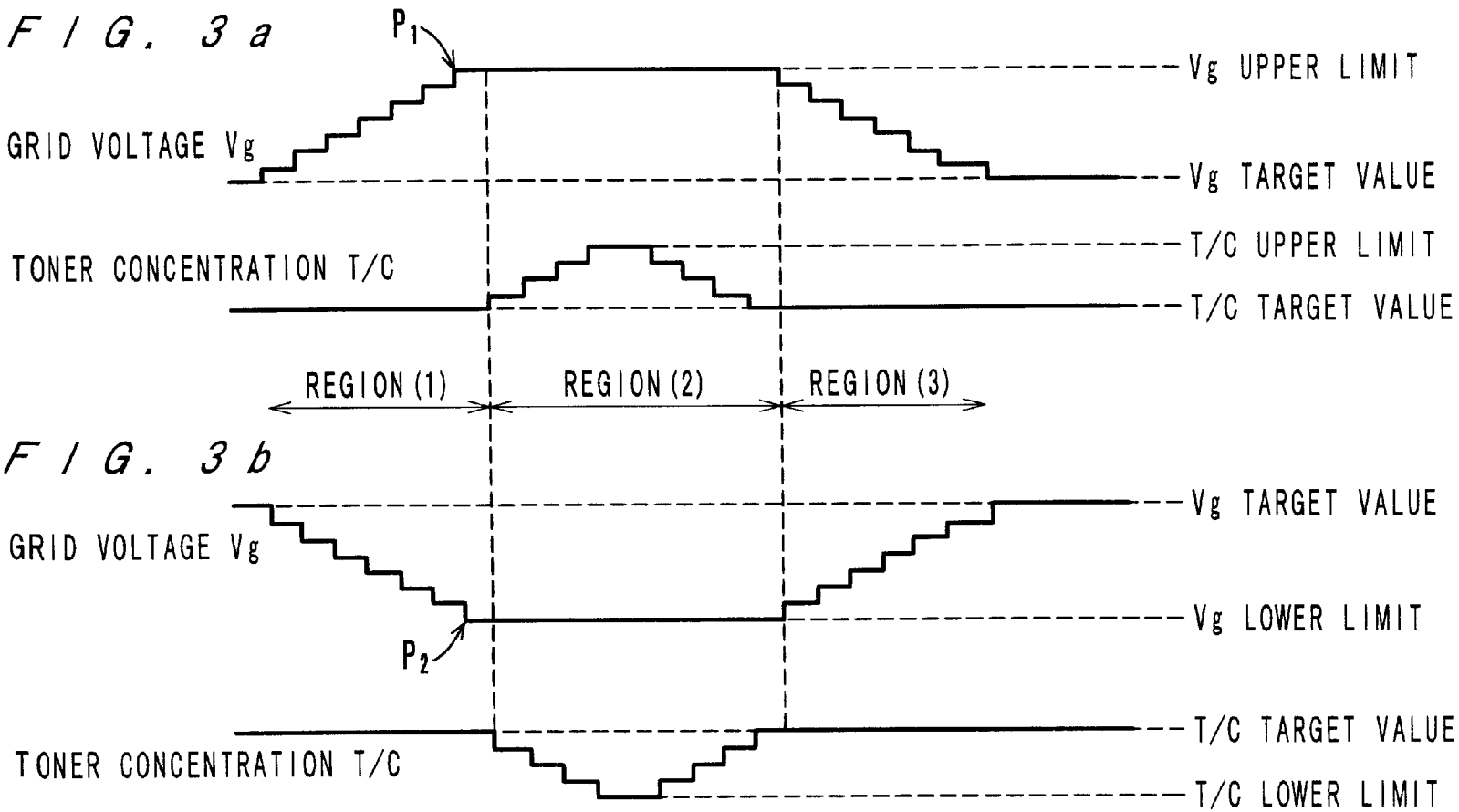
FIG. 3 is a chart which shows a model of an image density regulation process executed in the copying machine.

If the toner concentration T/C is the target value, the grid voltage Vg is changed by one step. At this time, if the density of the test pattern image is lower than the desired value, the grid voltage Vg is heightened by one step (see FIG. 3*a* region (1) and FIG. 3*b* region (3)), and if the density of the test pattern image is higher than the desired value, the grid voltage Vg is lowered by one step (see FIG. 3*a* region (3) and FIG. 3*b* region (1)). Thereafter, the grid voltage Vg is changed step by step while formation of the test pattern image and detection of the image density are carried out repeatedly. Then, when the image density of the test pattern image becomes equal to the desired value, the image density regulation process is completed. The voltage applied to the photosensitive drum 1 is changed according to the adjustment of the voltage Vg, and in this way, the image density can be stabilized responsively.

As described above, if the grid voltage Vg is changed too high or too low, it causes side effects such as toner deposition in the background of an image. In order to avoid such trouble, an upper limit and a lower limit are set to the grid voltage Vg. When the grid voltage Vg has been changed to the upper limit or to the lower limit (see FIG. 3*a* point $P_1$ and FIG. 3*b* point $P_2$), the image density regulation process is terminated even if the detected image density does not become the desired value. The copying machine carries out copying in this state. Then, in the next image density regulation process, if the grid voltage Vg is the upper limit or the lower limit, the toner concentration T/C is adjusted (see FIGS. 3*a* and 3*b* region (2)) while the grid voltage Vg is kept in the upper limit or the lower limit.

With respect to the adjustment of the toner concentration T/C, if the detected image density of the test pattern image is lower than the target value, the toner density T/C is heightened by one step, and if the detected image density is higher than the target value, the toner density T/C is lowered by one step. The image density does not change so responsively to the adjustment of the toner concentration T/C as to the adjustment of the grid voltage Vg, and therefore, the toner concentration T/C is changed by only one step in an image density regulation process. Supply of toner in the developing device 4 is carried out according to this adjustment of the toner concentration T/C.

In order to avoid trouble such as undercharging of toner, an upper limit and a lower limit are set to the toner concentration T/C. If the grid voltage Vg has been changed to the upper limit or to the lower limit and further if the toner concentration T/C is changed to the upper limit or to the lower limit, the image density regulation process does not go further, and a warning, such as an indication on the operation panel 80 or a buzz, is made.

In this embodiment, further, the target values of the grid voltage Vg and the toner concentration T/C are changed according to the number of copies which have been made in a multiple copying operation. Here, a multiple copying operation means an operation in which a plurality of copies are made by a switch-on of a copy start key on the operation panel 80 (see FIG. 2). When the ADF 60 is used for a multiple copying operation, the number of copies to be made in the copying operation is the number of documents × the number of copy sets to be made.

Copies made in the current operation are counted by the counter 81, and the number is stored in a CPU 90. The CPU 90 is the main part of the control section of the copying machine, and has a ROM in which a control program is stored and a RAM in which control parameters are stored. The CPU 90 receives detection signals from the sensors 23 and 43 and sends control signals to the electric sources 27, 28 and 42, and the toner hopper 44. The CPU 90 also exchanges necessary data with the operation panel 80 and the ADF 60.

In a multiple copying operation, as the number of copies is increasing, the temperature in the machine is rising, thereby deteriorating the toner in charging characteristic. Consequently, there occurs trouble such as spraying of toner from the developing section and deposition of toner in the background of an image. In order to avoid such trouble, the target value of the toner concentration T/C is lowered according to the number of copies made in a multiple copying operation. However, the drop in toner concentration T/C may cause a drop in image density, and in order to avoid this trouble, the grid voltage Vg is raised.

Figure 4:
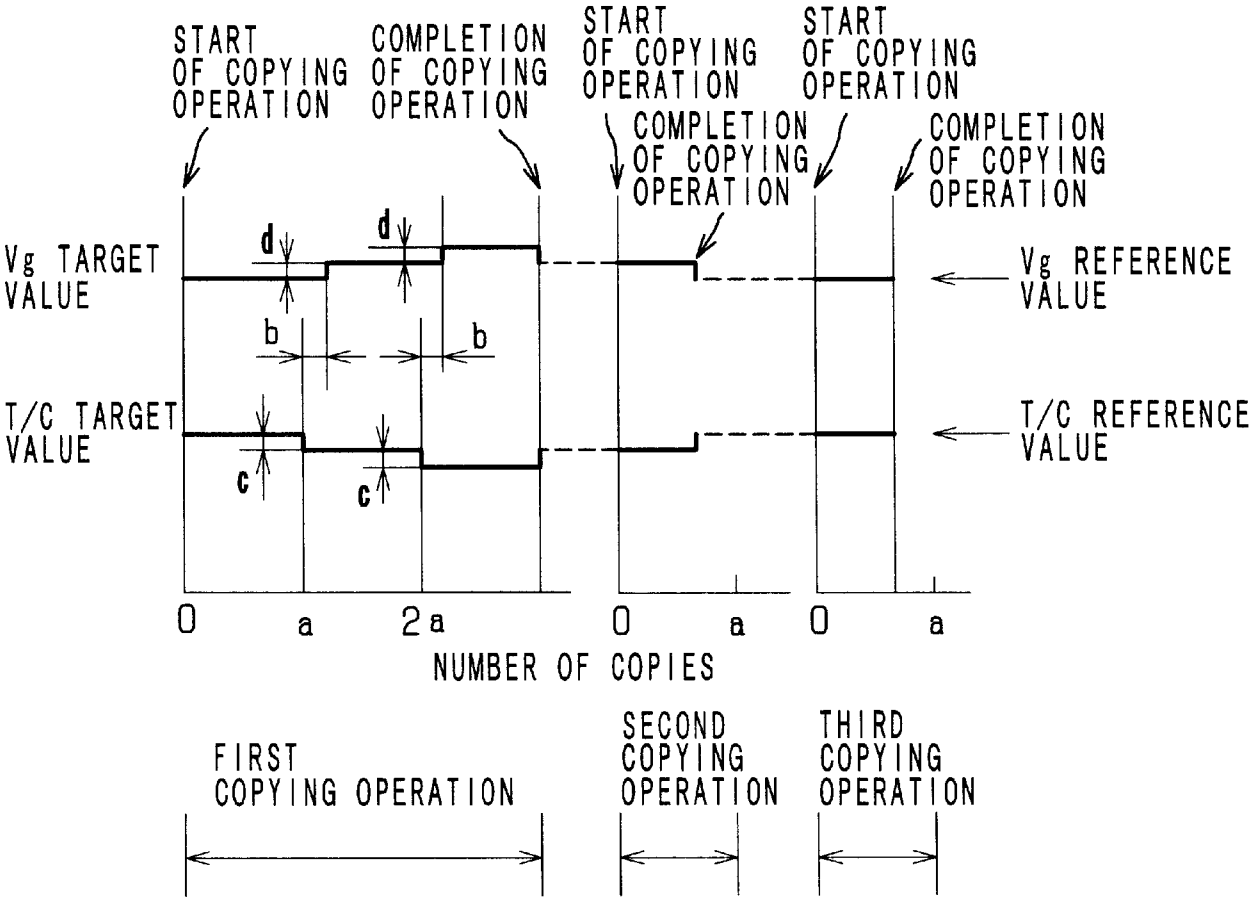
FIG. 4 is a chart which shows an exemplary way of changing target values used in the image density regulation process.

Referring to FIG. 4, this control is described more specifically. At the start of a first copying operation, the target values of the grid voltage Vg and the toner concentration T/C are set to the respective reference values. When the number of copies made in the operation becomes a predetermined number a, the target value of the toner concentration T/C is lowered by a specified value c, and when the number of copies becomes a+b, the target value of the grid voltage Vg is raised by d. Then, when the number of copies becomes 2*a*, the target value of the toner concentration T/C is lowered by one more step, and when the number of copies becomes $2a+b$, the target value of the grid voltage Vg is raised by one more step. Thus, every time the number of copies becomes a multiple of a, the target value of the toner concentration T/C is lowered by one step, and with a slight time lag, the target value of the grid voltage Vg is raised by one step. With this control, deterioration of the toner in charging characteristic due to a rise in temperature in the machine is prevented, and trouble such as spraying of the toner from the developing section and deposition of the toner in the background of an image can be prevented. Also, by carrying out the image density regulation process, the image density can be kept constant.

The reason why a time lag is set between the time of changing the target value of the toner concentration T/C and the time of changing the target value of the grid voltage Vg is that it takes time to supply the developer with the adjusted toner concentration to the developing section.

Further, when a multiple copying operation of making more than a copies is completed, the target value of the toner concentration T/C is raised by one step, and the target value of the grid voltage Vg is lowered by one step. Accordingly, in the next (second) copying operation, the image density regulation process is carried out with the target values of the toner concentration T/C and the grid voltage Vg back toward the respective reference values by one step. Thus, if the target values of the toner concentration T/C and the grid voltage Vg are not equal to the respective reference values when a copying operation is completed, the target values are returned toward the reference values by one step. This is to avoid unnecessary changes of the target values. The return of the target values may be carried out at the start of the next copying operation as well as on the completion of a copying operation.

The one-step rising and dropping of the target value of the toner concentration T/C can be carried out by using a toner supply table. The toner supply table is stored in the ROM of the CPU 90, and in the table, each table number indicates a time of driving the supply motor of the toner hopper 44, which determines the amount of supplied toner. The purpose achieved by the one-step rising and dropping of the target value of the toner concentration T/C can be also achieved by selecting a table number in the supply table appropriately.

Next, the main part of a control procedure of the copying machine is described.

Figure 5:
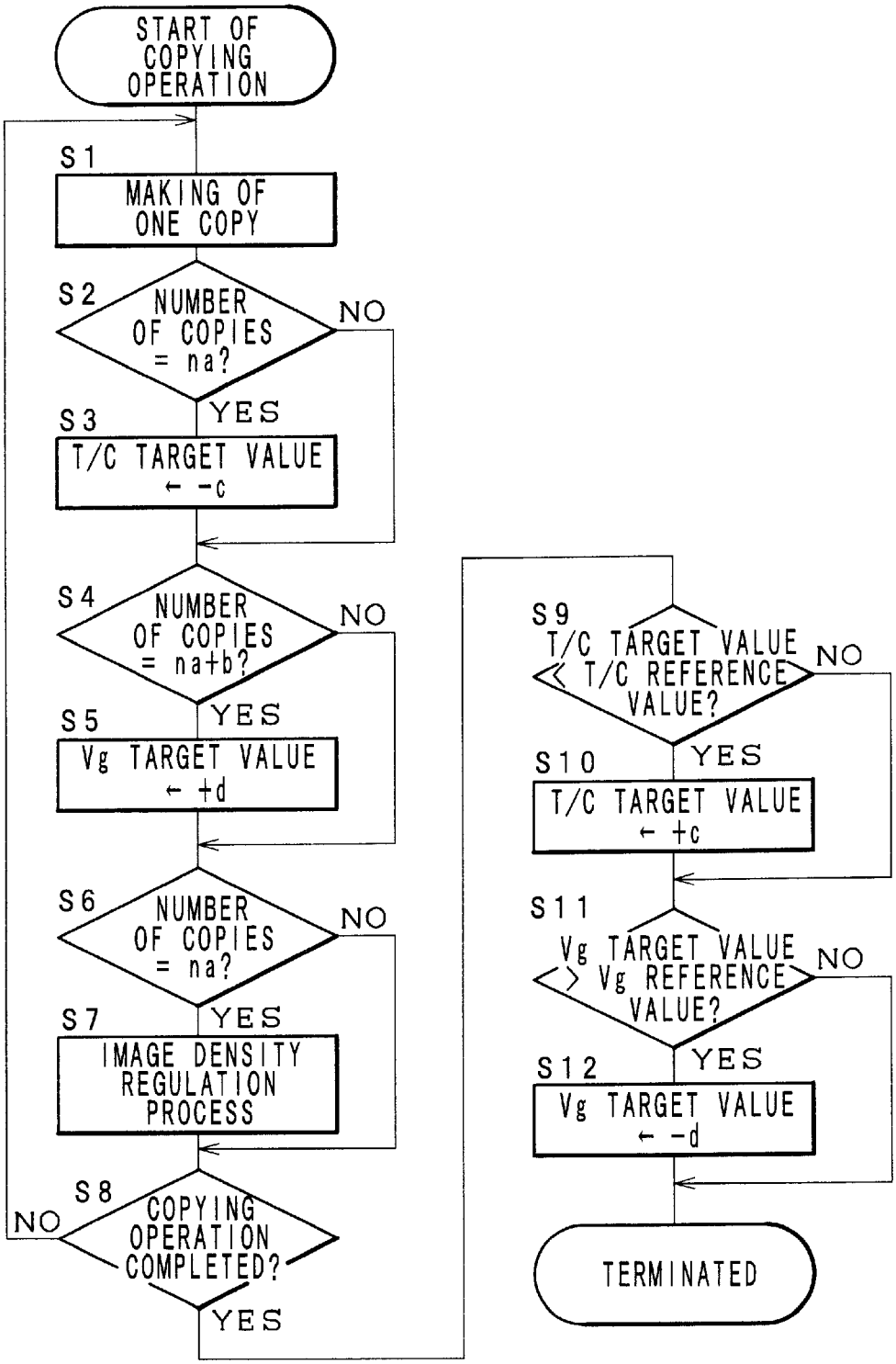
FIG. 5 is a flowchart which shows the main part of a control procedure of the copying machine.

As shown in FIG. 5, after the start of a copying operation, when the completion of making a copy is judged at step S1, the number of copies which have been made in the copying operation is judged whether or not to be na (n: natural number) at step S2. If "YES" at step S2, the target value of the toner concentration T/C is lowered by c at step S3. Further, the number of copies is judged whether or not to be na+b at step S4. If "YES" at step S4, the target value of the grid voltage Vg is heightened by d at step S5. Also, if it is judged at step S6 that the number of copies is na, the image density regulation process (see FIG. 6) is executed at step S7.

Next, it is judged at step S8 whether or not the copying operation is completed, and if the copying operation is not completed, the program returns to step S1. If the copying operation is completed, it is judged at step S9 whether or not the current target value of the toner concentration T/C is lower than its reference value. If the current target value is lower than the reference value, the target value is heightened by c at step S10. Further, it is judged at step S11 whether or not the current target value of the grid voltage Vg is higher than its reference value. If the current target value is higher than the reference value, the target value is lowered by d at step S12.

Figure 6:
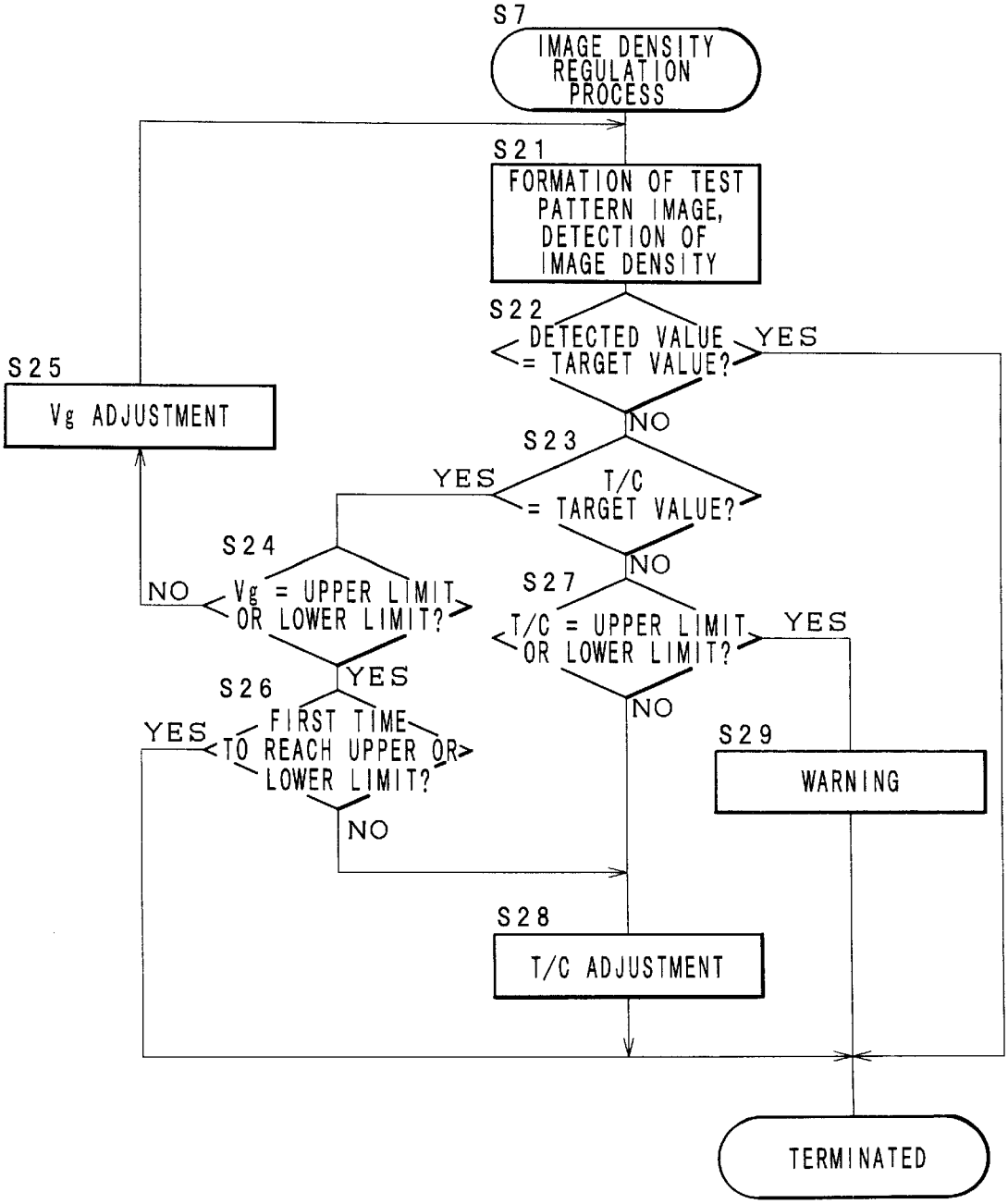
FIG. 6 is a flowchart which shows a control procedure for the image density regulation process.

FIG. 6 shows a procedure for the image density regulation process executed at step S7.

First at step S21, a test pattern image is formed, and the density of the image is detected. Then, it is judged at step S22 whether or not the detected value is equal to a target value. If the detected value is equal to the target value, regulation is not necessary, and this process is terminated. If the detected value is not equal to the target value, it is judged at step S23 whether or not the toner concentration T/C is its target value. If the toner concentration T/C is the target value, it is judged at step S24 whether or not the grid voltage Vg is the upper limit or the lower limit. When "NO" at step S24, the grid voltage Vg is adjusted at step S25. At this step, if the detected value of the image density is lower than the target value, the grid voltage Vg is one step heightened, and if the detected value is higher than the target value, the grid voltage Vg is one step lowered. Thereafter, steps S21 and S22 are executed again, and the grid voltage Vg is adjusted so that the detected value of the image density will become equal to the target value. When the detected value of the image density becomes equal to the target value, this regulation process is completed.

If the grid voltage Vg becomes the upper limit or the lower limit during the adjusting process of the grid voltage Vg ("YES" at step S24), it is judged at step S26 whether or not this is the first time to reach the upper limit or the lower limit. If "YES" at step S26, this regulation process is terminated. In other words, when the grid voltage Vg reaches the upper limit or the lower limit for the first time, a copying operation is executed with grid voltage Vg kept in the upper limit or the lower limit. Then, if the grid voltage Vg is judged to be the upper limit or the lower limit in the next image density regulation process ("NO" at step S26), the toner concentration T/C is adjusted at step S28. At this step, if the detected value of the density of the test pattern image is lower than the target value, the toner concentration T/C is one step heightened, and if the detected value is lower than the target value, the toner concentration T/C is one step lowered.

Thereafter, the toner concentration T/C is adjusted while the grid voltage Vg is kept in the upper limit or the lower limit. Specifically, when the toner concentration T/C is not its target value at step S23, after confirming at step S27 that the toner concentration T/C is not its upper limit or its lower limit, the toner concentration T/C is adjusted at step S28. If the toner concentration T/C reaches the upper limit or the lower limit during this adjustment process ("YES" at step S27), a warning is made at step S29 (for example, an indication is made on the operation panel 80), and this regulation process is terminated. Although the copying machine is capable of executing a copying operation even after the warning, a serviceman would make a checkout of the machine.

An image forming apparatus according to the present invention may be a digital type as well as an analog type. Also, the present invention is applicable to a full-color copying machine and a full-color printer.

Although the present invention has been described in connection with the preferred embodiment, it is to be noted that various changes and modifications are possible to those who are skilled in the art. Such changes and modifications are to be understood as being within the scope of the present invention.

What is claimed is:

1. An image forming apparatus which forms an image on a photosensitive material by an electrophotographic method, said image forming apparatus comprising:

a detecting device for detecting a state of an image formed on the photosensitive member;

a first adjusting device for adjusting a toner concentration in a developer according to a detection result of the detecting device;

a second adjusting device for adjusting a voltage to be applied to the photosensitive member according to the detection result of the detecting device;

a counting device for counting continuously formed images; and a control device which lowers a target value of the toner concentration to be achieved by the first adjusting device according to a count value of the counting device.

2. An image forming apparatus as claimed in claim 1, wherein the detecting device forms a test pattern image on the photosensitive member and detects a density of the test pattern image.

3. An image forming apparatus as claimed in claim 1, wherein the control device heightens a target value of the voltage to be achieved by the second adjusting means when lowering the target toner concentration.

4. An image forming apparatus as claimed in claim 1, wherein the control device lowers the target value of the toner concentration by one step every time the count value of the counting device reaches a multiple of a specified number.

5. An image forming apparatus as claimed in claim 4, wherein the control device heightens the target value of the voltage to be achieved by the second adjusting means by one step when lowering the target value of the toner concentration by one step.

6. An image forming apparatus as claimed in claim 4, wherein the control device heightens the target value of the toner concentration by one step if the target value is lower than a reference value when an image forming operation is completed.

7. An image forming apparatus as claimed in claim 5, wherein the control device lowers the target value of the voltage by one step if the target value is higher than a reference value when an image forming operation is completed.

8. An image density regulating method in an image forming apparatus which forms a toner image on a photosensitive member by an electrophotographic method, said image density regulating method comprising:

a detecting step of detecting a state of an image formed on the photosensitive member every time a specified number of images are continuously formed;

an adjusting step of adjusting a toner concentration in a developer and/or a voltage to be applied to the photosensitive member according to a detection result of the detecting step; and a controlling step of lowering a target value of the toner concentration by one step every time a specified number of images are continuously formed.

9. An image density regulating method as claimed in claim 8, wherein in the controlling step, a target value of the voltage to be applied to the photosensitive member is heightened by one step when the target value of the toner concentration is lowered by one step.

10. An image forming apparatus comprising:

an image bearing member;

a latent image forming device for forming a latent image on the image bearing member according to a target value of an intensity level of a latent image;

a developing device for developing the latent image according to a target value of an image density;

a counting device for counting developments carried out by the developing device; and a control device for changing the target value of the image density according to a count value of the counting device.

11. An image forming apparatus as claimed in claim 10, wherein the control device lowers the target value of the image density according to the count value of the counting device.

12. An image forming apparatus as claimed in claim 11, wherein the control device heightens the target value of the intensity level of a latent image when lowering the target value of the image density.

13. An image forming apparatus as claimed in claim 10, further comprising:

a detecting device for detecting a state of an image developed on the image bearing member;

a first adjusting device for adjusting developing conditions of the developing device according to a detection result of the detecting device and the target value of the image density;

a second adjusting device for adjusting latent image forming conditions of the latent image forming device according to the detection result of the detecting device and the target value of the intensity level of a latent image.

14. An image forming apparatus as claimed in claim 13, wherein the control device lowers the target value of the image density according to the count value of the counting device.

* * * * *